US010753631B2

(12) United States Patent
Ikawa et al.

(10) Patent No.: US 10,753,631 B2
(45) Date of Patent: Aug. 25, 2020

(54) AIR-CONDITIONER INDOOR UNIT

(71) Applicant: DAIKIN INDUSTRIES, LTD., Osaka-Shi, Osaka (JP)

(72) Inventors: Shinsuke Ikawa, Osaka (JP); Akio Tasaka, Osaka (JP); Hiroyuki Tada, Osaka (JP); Seiko Kitamura, Osaka (JP); Shinji Nagaoka, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 101 days.

(21) Appl. No.: 15/523,060

(22) PCT Filed: Sep. 29, 2015

(86) PCT No.: PCT/JP2015/077565
§ 371 (c)(1),
(2) Date: Apr. 28, 2017

(87) PCT Pub. No.: WO2016/067816
PCT Pub. Date: May 6, 2016

(65) Prior Publication Data

US 2017/0314805 A1 Nov. 2, 2017

(30) Foreign Application Priority Data

Oct. 31, 2014 (JP) ..... 2014-223393

(51) Int. Cl.
*F24F 11/36* (2018.01)
*F24F 11/89* (2018.01)
(Continued)

(52) U.S. Cl.
CPC ..... *F24F 11/36* (2018.01); *F24F 11/89* (2018.01); *F24F 13/20* (2013.01); *F25B 49/005* (2013.01); *F25B 2400/12* (2013.01)

(58) Field of Classification Search
CPC ..... F24F 11/89; F24F 11/36; F24F 2013/207; F25B 2500/222; F25B 2500/22; F25B 2400/12; F25B 2400/121; F25B 49/005
See application file for complete search history.

(56) References Cited

U.S. PATENT DOCUMENTS

2009/0205352 A1* 8/2009 Choi ..... F24F 13/20 62/259.1
2013/0098576 A1 4/2013 Fujitaka et al.

FOREIGN PATENT DOCUMENTS

JP 5-79655 A 3/1993
JP 10-115478 A 5/1998
(Continued)

OTHER PUBLICATIONS

Partial English Machine Translation. WO 2011143937. Accessed Oct. 2018.*
(Continued)

*Primary Examiner* — Tavia Sullens
(74) *Attorney, Agent, or Firm* — Birch, Stewart, Kolasch & Birch, LLP

(57) ABSTRACT

When a service technician or the like performs maintenance of a mechanism in an indoor unit, the service technician may accidentally detach a refrigerant gas sensor and the refrigerant gas sensor may be broken. To prevent this, communication pipes (regulating members) configured to regulate the detachment of a refrigerant gas sensor are provided on the side toward which the refrigerant gas sensor is detached (front side) when a casing provided on the side toward which the refrigerant gas sensor is detached (front side) is open.

13 Claims, 14 Drawing Sheets

(51) Int. Cl.

| | |
|---|---|
| ***F24F 13/20*** | (2006.01) |
| ***F25B 49/02*** | (2006.01) |
| ***F25B 49/00*** | (2006.01) |

(56) References Cited

FOREIGN PATENT DOCUMENTS

| | | | | | |
|---|---|---|---|---|---|
| JP | 2009093467 | A | * | 4/2009 | |
| JP | 2010-78219 | A | | 4/2010 | |
| JP | 2012-13348 | A | | 1/2012 | |
| JP | 2013-64524 | A | | 4/2013 | |
| JP | 2013-141880 | A | | 7/2013 | |
| JP | 2013-220105 | A | | 10/2013 | |
| JP | 2014-81160 | A | | 5/2014 | |
| WO | WO 2011143937 | A1 | * | 11/2011 | ..... F25B 49/005 |

OTHER PUBLICATIONS

Partial English Machine Translation JP 2009093467, Accessed Dec. 2019.*

International Search Report, issued in PCT/JP2015/077565 (PCT/ISA/210), dated Dec. 22, 2015.

* cited by examiner

AIR-CONDITIONER INDOOR UNIT

TECHNICAL FIELD

The present invention relates to an indoor unit of an air conditioner using flammable refrigerant.

An air conditioner using flammable refrigerant, in which a refrigerant gas sensor is attached to an indoor unit of the air conditioner, has been known.

CITATION LIST

Patent Literature

[Patent Literature 1] Japanese Unexamined Patent Publication No. 2012-13348

SUMMARY OF INVENTION

Technical Problem

In regard to the indoor unit of the air conditioner described above, when a service technician or the like performs maintenance of the mechanism in the indoor unit (in particular when, for example, an electronic component box is detached), the service technician may accidentally detach a refrigerant gas sensor and the refrigerant gas sensor may be broken.

An object of the present invention is therefore to provide an indoor unit of an air conditioner, from which a refrigerant gas sensor is not easily detachable.

Solution to Problem

According to the first aspect of the invention, an indoor unit of an air conditioner using flammable refrigerant includes: a casing; an indoor heat exchanger provided in the casing; a sensor mounting portion provided in the casing; a refrigerant gas sensor detachably attached to the sensor mounting portion; and a regulating member which is configured to regulate detachment of the refrigerant gas sensor in a detaching direction of the refrigerant gas sensor, when the casing is open.

In this indoor unit of the air conditioner, the regulating member regulating the detachment of the refrigerant gas sensor when the casing is open is provided on the side toward which the refrigerant gas sensor is detached is provided. This prevents the refrigerant gas sensor from being easily detached. This prevents malfunction of the refrigerant gas sensor due to erroneous detachment of the refrigerant gas sensor by a service technician or the like.

According to the second aspect of the invention, the indoor unit of the first aspect is arranged such that the refrigerant gas sensor is detached by sliding the refrigerant gas sensor for a predetermined distance in the detaching direction of the refrigerant gas sensor, relative to the sensor mounting portion, and the regulating member is provided in a sliding range of the refrigerant gas sensor.

In this indoor unit of the air conditioner, in the arrangement in which the refrigerant gas sensor is detached from the sensor mounting portion in such a way that the refrigerant gas sensor is slid in the detaching direction of the refrigerant gas sensor, the regulating member is provided in the sliding range of the refrigerant gas sensor. It is therefore possible to prevent the refrigerant gas sensor from being easily detached.

According to the third aspect of the invention, the indoor unit of the first or second aspect is arranged such that the sensor mounting portion includes a sensor fixing portion for fixing the refrigerant gas sensor, the refrigerant gas sensor is detached from the sensor mounting portion after a fixing member fixed to the sensor fixing portion is detached, and the regulating member is provided on a side toward which the fixing member is detached.

In this indoor unit of the air conditioner, in the arrangement in which the refrigerant gas sensor is detached from the sensor mounting portion after the fixing member is detached from the sensor mounting portion, the regulating member is provided on the side toward which the fixing member is detached. It is therefore possible to prevent the refrigerant gas sensor from being easily detached.

According to the fourth aspect of the invention, the indoor unit of any one of the first to third aspects further includes an electronic component box provided on an outer side in a longitudinal direction of the indoor heat exchanger, the refrigerant gas sensor being provided on the outer side in the longitudinal direction of the indoor heat exchanger and on the same side as the electronic component box.

In this indoor unit of the air conditioner, when the refrigerant gas sensor is provided on the same side of the electronic component box relative to the indoor heat exchanger and hence the refrigerant gas sensor tends to be detached by mistake, the regulating member for regulating the detachment of the refrigerant gas sensor is provided on the side toward which the refrigerant gas sensor is detached. It is therefore possible to prevent the refrigerant gas sensor from being easily detached.

According to the fifth aspect of the invention, the indoor unit of any one of the first to fourth aspects is arranged such that the regulating member is a communication pipe which is connected with a refrigerant pipe extending from the indoor heat exchanger.

In this indoor unit of the air conditioner, because the regulating member is the communication pipe connected with the refrigerant pipe extending to the indoor heat exchanger, the refrigerant gas sensor cannot be detached unless the refrigerant in the refrigerant circuit is removed and the communication pipe is detached. It is therefore possible to further prevent the detachment of the refrigerant gas sensor. Furthermore, because the detachment of the refrigerant gas sensor is prevented by using the communication pipe which is conventionally provided inside the indoor unit, it is unnecessary to provide an additional arrangement for preventing the detachment of the refrigerant gas sensor.

According to the sixth aspect of the invention, the indoor unit of any one of the first to fourth aspects is arranged such that the regulating member is a heat insulating material.

In this indoor unit of the air conditioner, because the detachment of the refrigerant gas sensor is prevented by using the communication pipe which is conventionally provided inside the indoor unit, it is unnecessary to provide an additional arrangement for preventing the detachment of the refrigerant gas sensor.

According to the seventh aspect of the invention, the indoor unit of the fourth aspect is arranged such that the regulating member is the electronic component box.

In this indoor unit of the air conditioner, because the detachment of the refrigerant gas sensor is prevented by using the communication pipe which is conventionally provided inside the indoor unit, it is unnecessary to provide an additional arrangement for preventing the detachment of the refrigerant gas sensor.

Advantageous Effects of Invention

As described hereinabove, the present invention brings about the following effects.

According to the first aspect of the invention, the regulating member regulating the detachment of the refrigerant gas sensor is provided on the side toward which the refrigerant gas sensor is detached when the casing is open is provided. This prevents the refrigerant gas sensor from being easily detached. This prevents malfunction of the refrigerant gas sensor due to erroneous detachment of the refrigerant gas sensor by a service technician or the like.

According to the second aspect of the invention, in the arrangement in which the refrigerant gas sensor is detached from the sensor mounting portion in such a way that the refrigerant gas sensor is slid in the detaching direction of the refrigerant gas sensor, the regulating member is provided in the sliding range of the refrigerant gas sensor. It is therefore possible to prevent the refrigerant gas sensor from being easily detached.

According to the third aspect of the invention, in the arrangement in which the refrigerant gas sensor is detached from the sensor mounting portion after the fixing member is detached from the sensor mounting portion, the regulating member is provided on the side toward which the fixing member is detached. It is therefore possible to prevent the refrigerant gas sensor from being easily detached.

According to the fourth aspect of the invention, when the refrigerant gas sensor is provided on the same side of the electronic component box relative to the indoor heat exchanger and hence the refrigerant gas sensor tends to be detached by mistake, the regulating member for regulating the detachment of the refrigerant gas sensor is provided on the side toward which the refrigerant gas sensor is detached. It is therefore possible to prevent the refrigerant gas sensor from being easily detached.

According to the fifth aspect of the invention, because the regulating member is the communication pipe connected with the refrigerant pipe extending to the indoor heat exchanger, the refrigerant gas sensor cannot be detached unless the refrigerant in the refrigerant circuit is removed and the communication pipe is detached. It is therefore possible to further prevent the detachment of the refrigerant gas sensor. Furthermore, because the detachment of the refrigerant gas sensor is prevented by using the communication pipe which is conventionally provided inside the indoor unit, it is unnecessary to provide an additional arrangement for preventing the detachment of the refrigerant gas sensor.

According to the sixth aspect of the invention, because the detachment of the refrigerant gas sensor is prevented by using the communication pipe which is conventionally provided inside the indoor unit, it is unnecessary to provide an additional arrangement for preventing the detachment of the refrigerant gas sensor.

According to the seventh aspect of the invention, because the detachment of the refrigerant gas sensor is prevented by using the communication pipe which is conventionally provided inside the indoor unit, it is unnecessary to provide an additional arrangement for preventing the detachment of the refrigerant gas sensor.

BRIEF DESCRIPTION OF DRAWINGS

FIG. 10A is a perspective view showing a state that a lower housing is detached from a refrigerant gas sensor shown in FIG. 5, whereas

DESCRIPTION OF EMBODIMENTS

The following will describe an air conditioner according to an embodiment of the present invention, with reference to drawings.

[Overall Structure of Air Conditioner]

Figure 1:
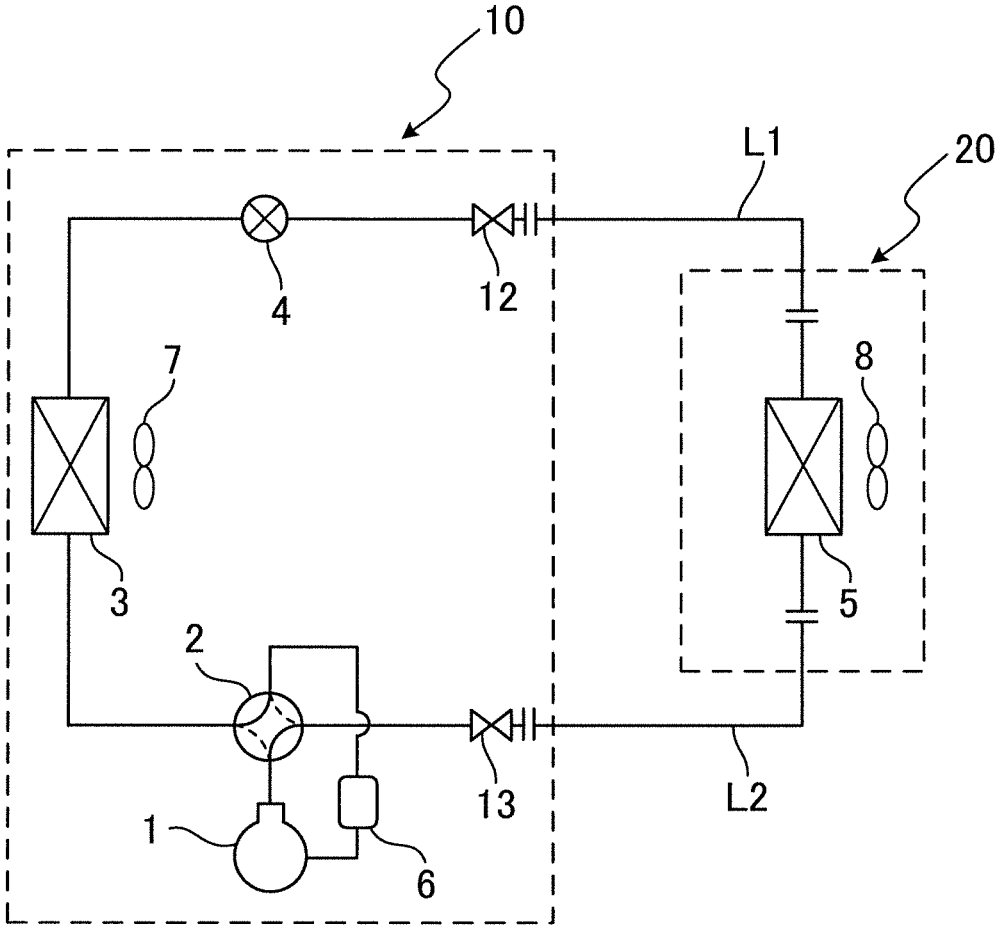
FIG. 1 is a circuit diagram showing a refrigerant circuit of an air conditioner of an embodiment of the present invention.

As shown in FIG. 1, an air conditioner of the present embodiment includes a compressor 1, a four-pass switching valve 2 having one end connected with the discharging side of the compressor 1, an outdoor heat exchanger 3 having one end connected with the other end of the four-pass switching valve 2, an electric expansion valve 4 having one end connected with the other end of the outdoor heat exchanger 3, an indoor heat exchanger 5 having one end connected with the other end of the electric expansion valve 4 via a stop valve 12 and a communication pipe L1, and an accumulator 6 having one end connected with the other end of the indoor heat exchanger 5 via a stop valve 13, a communication pipe L2, and the four-pass switching valve 2 and the other end connected with the sucking side of the compressor 1. The compressor 1, the four-pass switching valve 2, the outdoor heat exchanger 3, the electric expansion valve 4, the indoor heat exchanger 5, and the accumulator 6 form a refrigerant circuit.

In addition to the above, the air conditioner includes an outdoor fan 7 provided in the vicinity of the outdoor heat exchanger 3, and an indoor fan 8 provided in the vicinity of the indoor heat exchanger 5. The compressor 1, the four-pass switching valve 2, the outdoor heat exchanger 3, the electric expansion valve 4, the accumulator 6, and the outdoor fan 7 are provided in an outdoor unit 10, whereas the indoor heat exchanger 5 and the indoor fan 8 are provided in an indoor unit 20.

In this air conditioner, in a warming operation, as the four-pass switching valve 2 is switched to a position indicated by full lines and the compressor 1 is activated, high-pressure refrigerant discharged from the compressor 1 enters the indoor heat exchanger 5 through the four-pass switching valve 2. The refrigerant condensed in the indoor heat exchanger 5 is depressurized in the electric expansion valve 4 and then enters the outdoor heat exchanger 3. The refrigerant evaporated in the outdoor heat exchanger 3 returns to the sucking side of the compressor 1 via the four-pass switching valve 2 and the accumulator 6. In this way, a refrigerating cycle is formed such that the refrigerant circulates in the refrigerant circuit constituted by the compressor 1, the indoor heat exchanger 5, the electric expansion valve 4, the outdoor heat exchanger 3, and the accumulator 6. The room is warmed in such a way that room air is circulated by the indoor fan 8 through the indoor heat exchanger 5.

In the meanwhile, in a cooling operation (including a dehumidification operation), as the four-pass cooling operation 2 is switched to a position indicated by dotted lines and the compressor 1 is activated, high-pressure refrigerant discharged from the compressor 1 enters the outdoor heat exchanger 3 through the four-pass switching valve 2. The refrigerant condensed in the outdoor heat exchanger 3 is depressurized in the electric expansion valve 4 and then enters the indoor heat exchanger 5. The refrigerant evaporated in the indoor heat exchanger 5 returns to the sucking side of the compressor 1 via the four-pass switching valve 2 and the accumulator 6. In this way, a refrigerating cycle is formed such that the refrigerant circulates through the compressor 1, the outdoor heat exchanger 3, the electric expansion valve 4, the indoor heat exchanger 5, and the accumulator 6 in this order. The room is cooled in such a way that room air is circulated by the indoor fan 8 through the indoor heat exchanger 5.

This air conditioner uses flammable refrigerant. In the present invention, the term "flammable refrigerant" encompasses not only flammable refrigerant but also mildly flammable refrigerant. While the air conditioner uses R32 which is mildly flammable refrigerant, the air conditioner may use R290, for example. The air conditioner uses refrigerant having a higher specific gravity than air.

[Indoor Unit]

Figure 2:
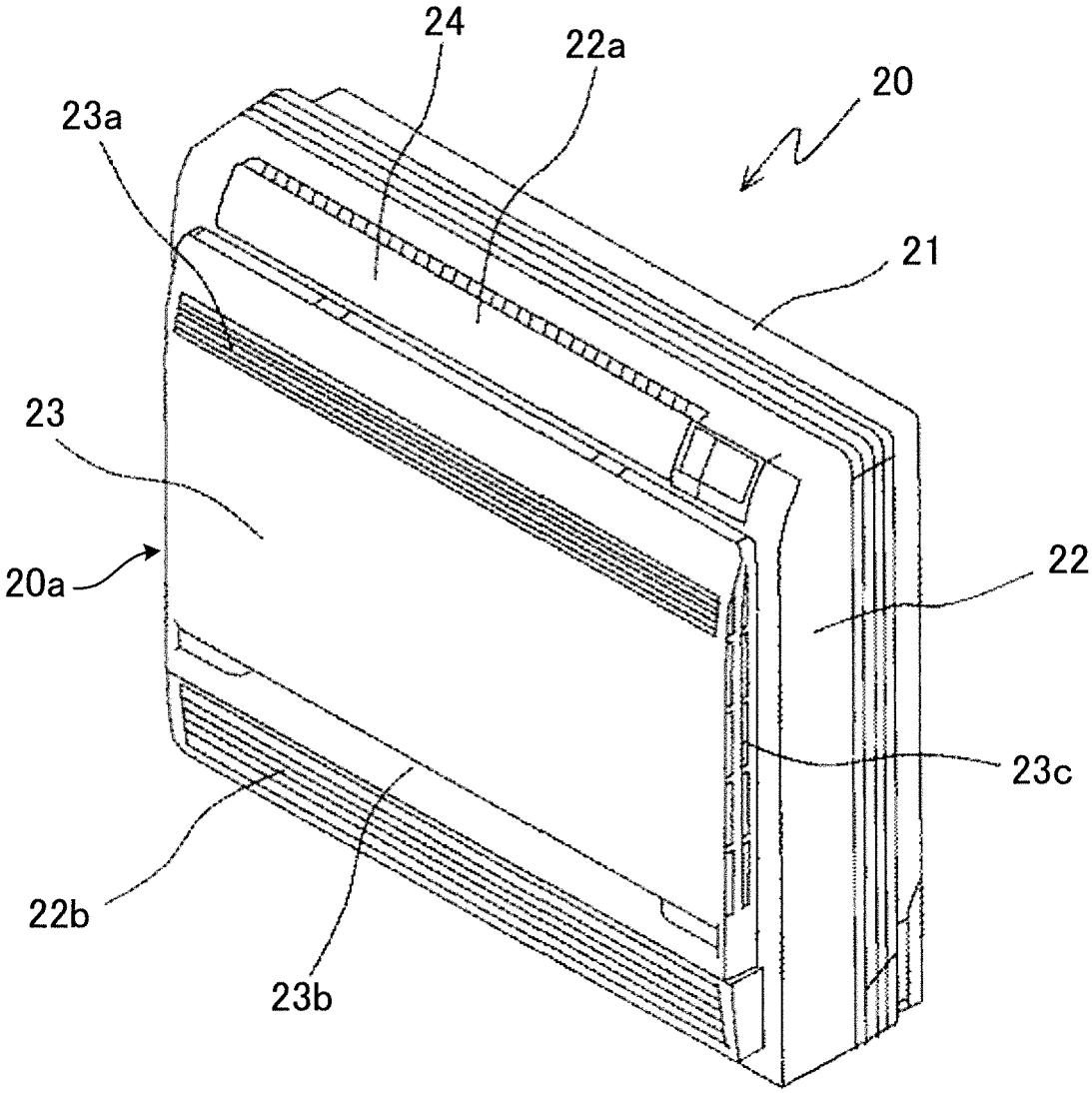
FIG. 2 is a perspective view of an indoor unit shown in FIG. 1.
Figure 3:
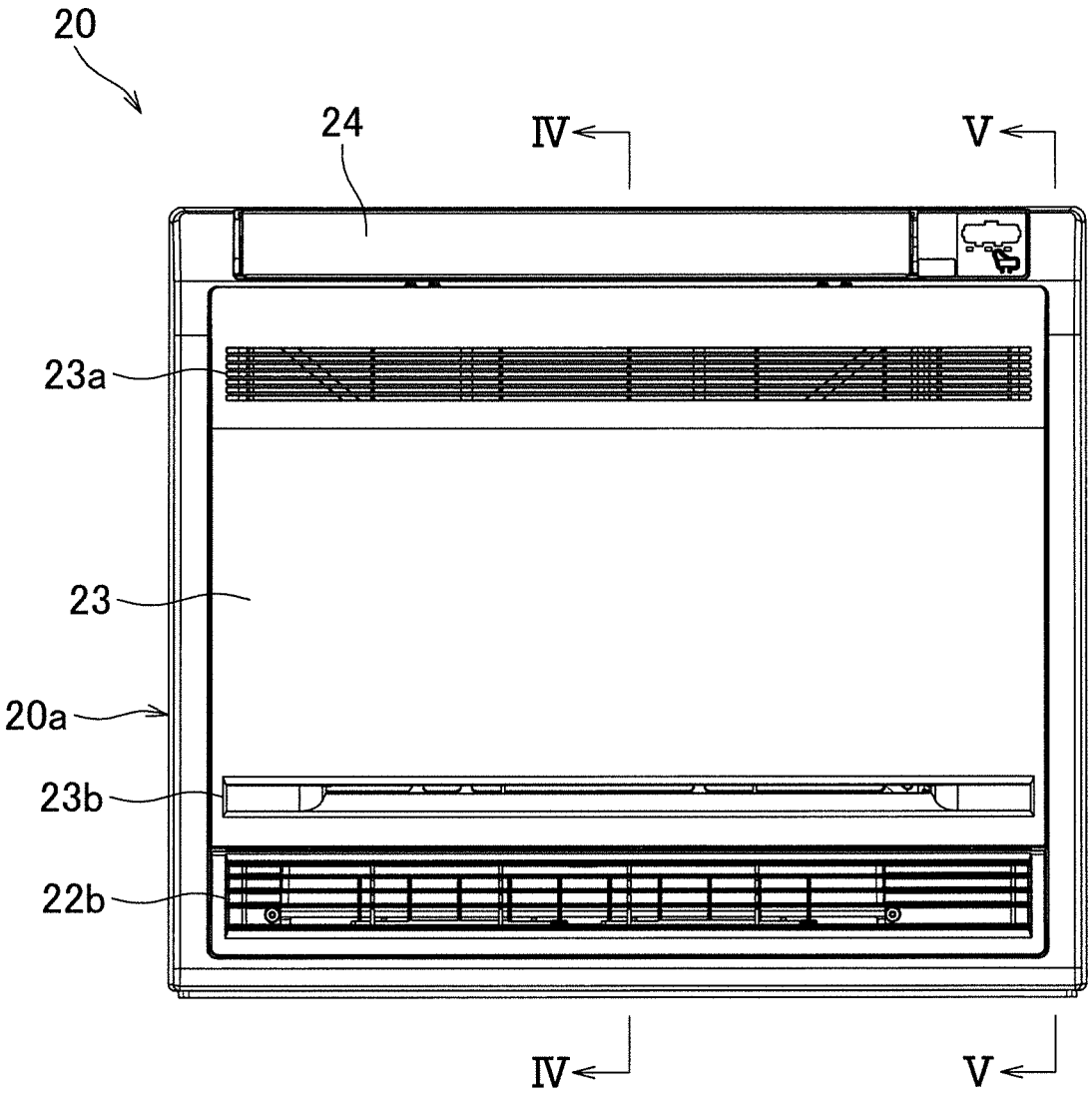
FIG. 3 is a front view of the indoor unit.
Figure 4:
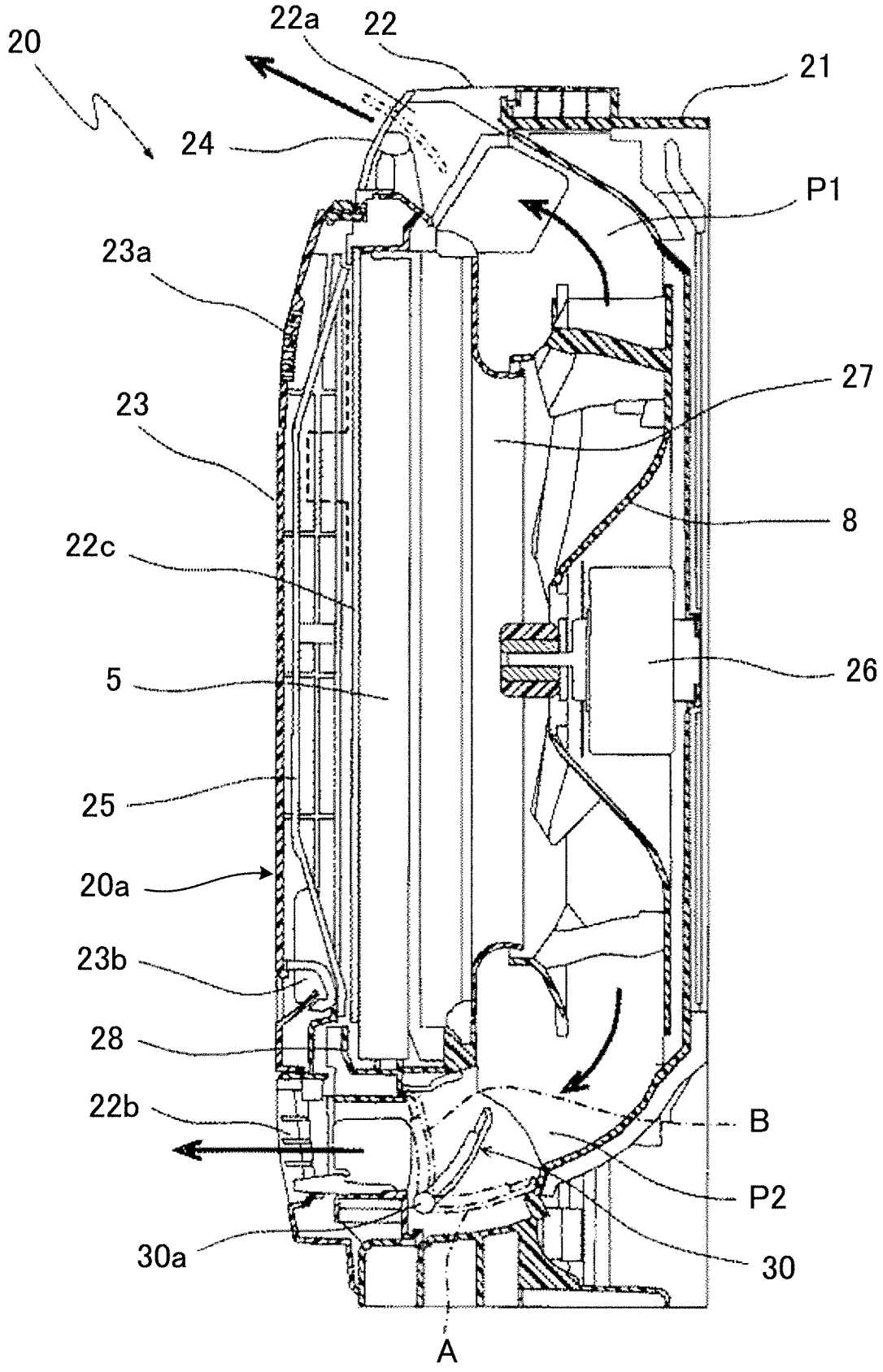
FIG. 4 is a cross section taken along the IV-IV line in FIG. 3.

As shown in FIG. 2 to FIG. 4, the indoor unit 20 is a floor-mounted indoor unit and includes a bottom frame 21 which is substantially rectangular in shape, the back surface side of the bottom frame 21 being attached to a wall of the room, a front grill 22 which is attached to the front surface side of the bottom frame 21 and has a substantially rectangular opening 22*c* in the front surface, and a front panel 23 attached to cover the opening 22*c* of the front grill 22. The bottom frame 21, the front grill 22, and the front panel 23 form a casing 20*a*.

An upper outlet port 22*a* is formed at an upper part of the front grill 22, whereas a lower outlet port 22*b* is formed at a lower part of the front grill 22. In an upper outlet path P1 communicating with the upper outlet port 22*a*, a vertical flap 24 is provided to change, in the up-down direction, the direction of the air flow blown out from the upper outlet port 22*a*. The vertical flap 24 is connected with a flap motor 24*a* (see FIG. 9). The vertical flap 24 is rotatable about the rotational axis along the horizontal direction, by the driving of the flap motor 24*a*. During the cooling operation or the warming operation, this vertical flap 24 rotates to a position where cool wind or warm wind is blown out forward and obliquely upward from the upper outlet port 22*a*, and stops at this position. During the operation stop, the upper outlet port 22*a* is closed as shown in FIG. 2.

In the meanwhile, in a lower outlet path P2 communicating with the lower outlet port 22*b*, a shutter 30 configured to open and close the lower outlet port 22*b* and a horizontal flap 31 configured to change, in the left-right direction, the direction of the air flow blown out from the lower outlet port 22*b* are provided. The shutter 30 is connected with a shutter motor 30*b*. As shown in FIG. 4, the shutter 30 rotates about the axis 30*a* extending along the horizontal direction, by the driving of the shutter motor 30*b*. This shutter 30 stops at a position A indicated by a one dot chain line to open the lower outlet port 22*b*, and stops at a position B indicated by a one dot chain line to close the lower outlet port 22*b*. The direction of the horizontal flap 31 is manually adjusted.

An upper inlet port 23*a* is formed at an upper part of the front panel 23, a lower inlet port 23*b* is formed at a lower part of the front panel 23, and side inlet ports 23*c* (only the right one is shown in FIG. 2) are formed through side faces of the front panel 23.

As shown in FIG. 4, a fan motor 26 is fixed at a substantial center of the bottom frame 21. The indoor fan 8 connected with the axis of the fan motor 26 is disposed in the bottom frame 21 so that the axis of the fan extends along the front-back direction. The indoor fan 8 is a turbofan which sucks air from the front surface side and blows the air radially outward with respect to the axis. The bottom frame 21 includes a bell-mouth 27 formed on the front surface side of the indoor fan 8. The indoor heat exchanger 5 is provided on the front surface side of the bell-mouth 27, and the front grill 22 is attached to the front surface side of the indoor heat exchanger 5. Furthermore, the front panel 23 is attached to the front surface side of the front grill 22. To the opening 22*c* of the front grill 22, a filter 25 is attached.

Figure 5:
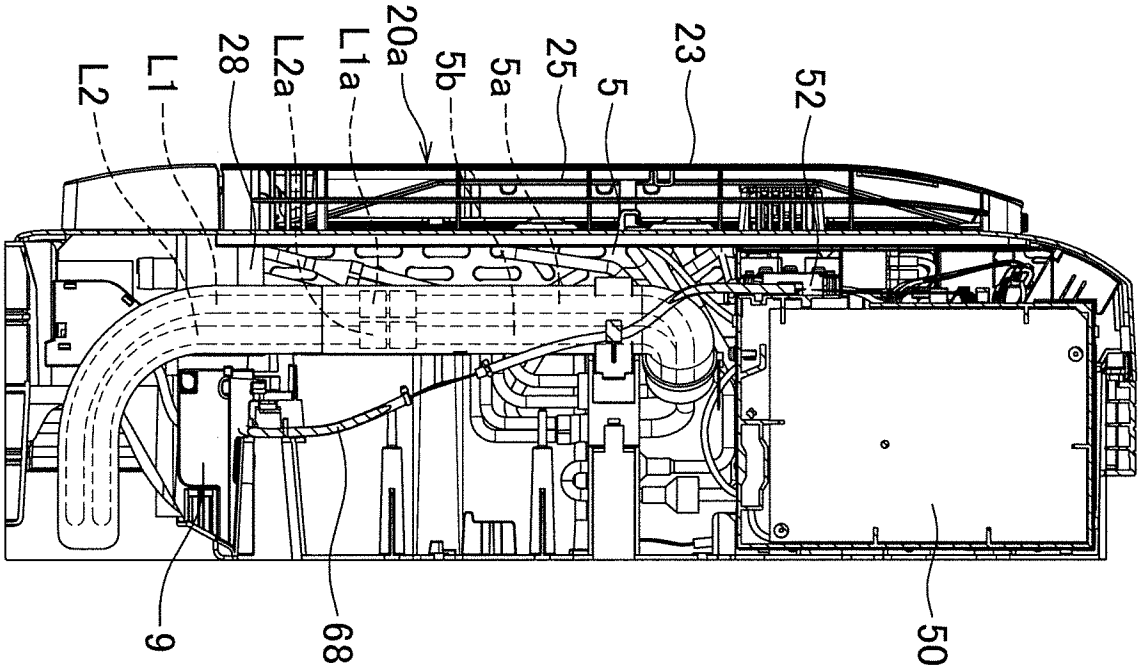
FIG. 5 is a cross section taken along the V-V line in FIG. 3.
Figure 6:
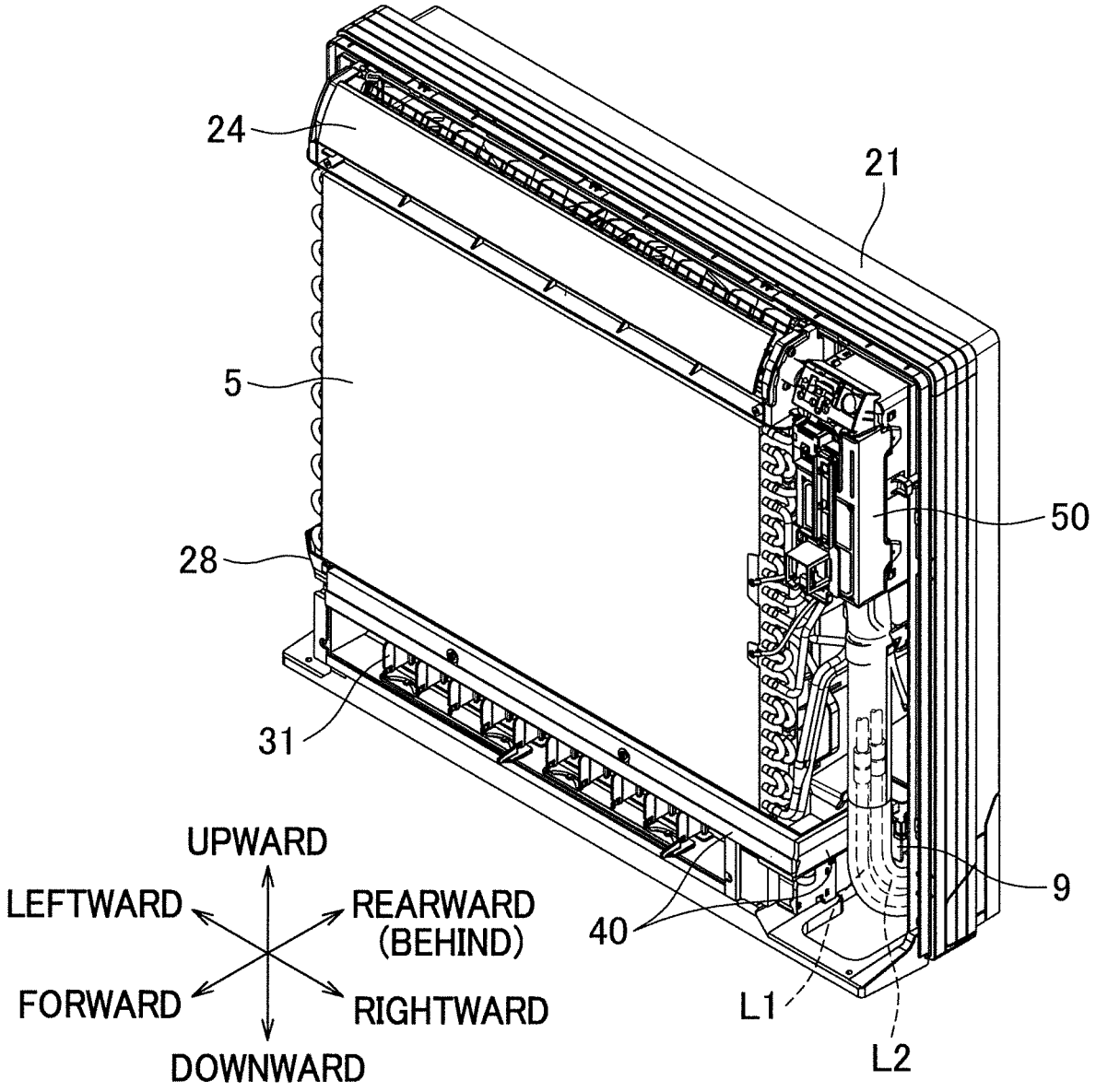
FIG. 6 is a perspective view of the indoor unit from which a front grill and a front panel have been detached.
Figure 7:
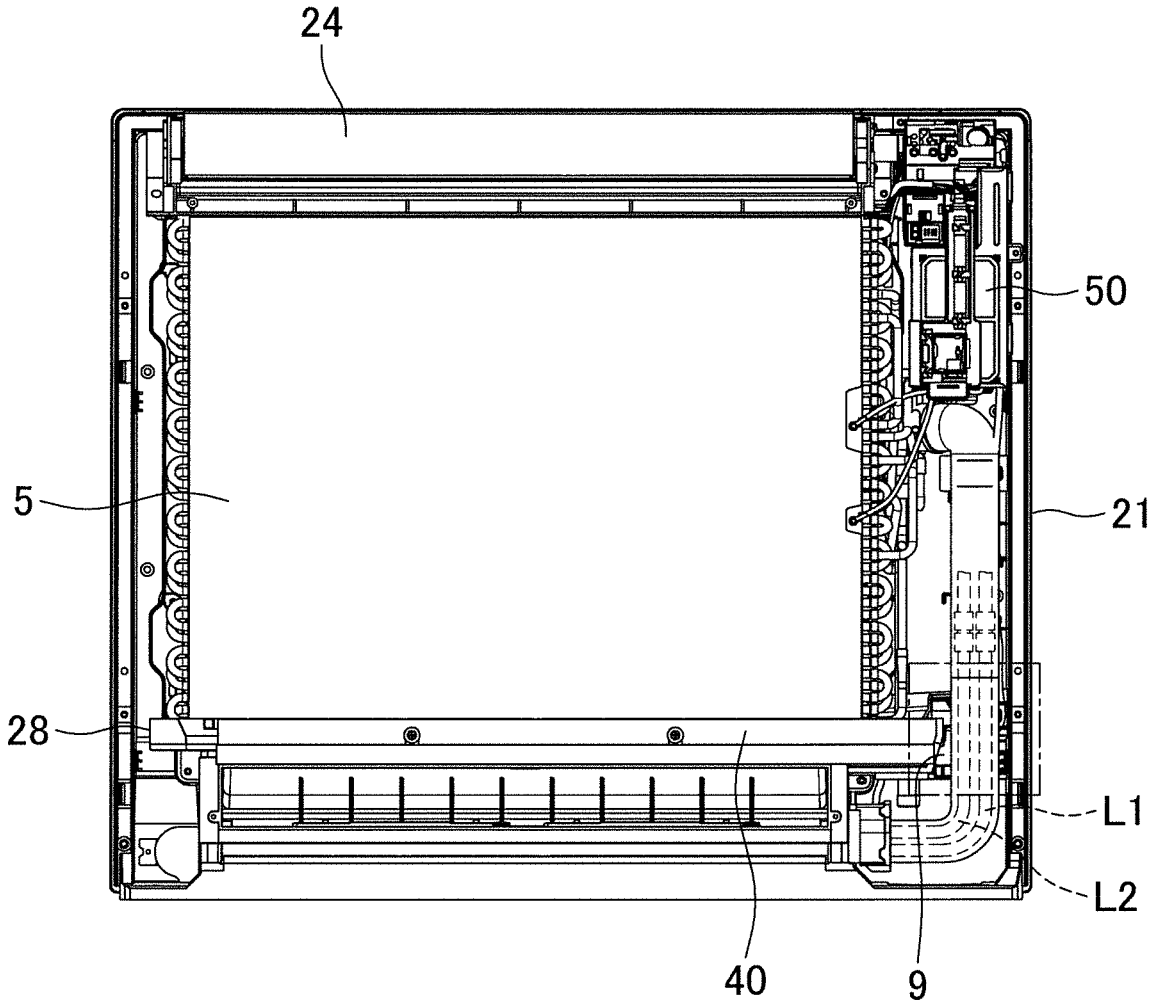
FIG. 7 is a front elevation of the indoor unit from which the front grill and the front panel have been detached.
Figure 11A:
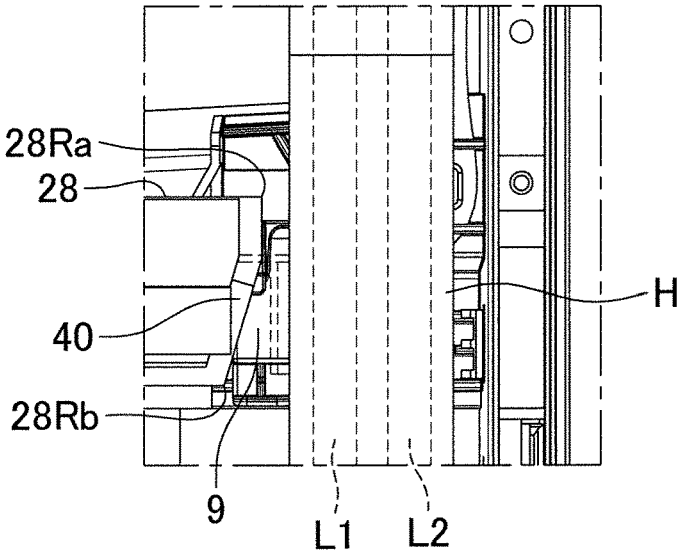
FIG. 11A is a front enlarged view of a part where the refrigerant gas sensor is provided.

As the driving of the air conditioner starts, the fan motor 26 is driven so that the indoor fan 8 rotates. As the indoor fan 8 rotates, room air is sucked into the indoor unit 20 through the upper inlet port 23*a*, the lower inlet port 23*b*, and the side inlet ports 23*c*. The room air sucked into the indoor unit 20 is subjected to the heat exchange by the indoor heat exchanger 5, and is then blown out to the room through the upper outlet port 22*a* and the lower outlet port 22*b*. When the lower outlet port 22*b* is closed by the shutter 30, the room air sucked into the indoor unit 20 is blown out only through the upper outlet port 22*a*. As shown in FIG. 5 to FIG. 7, a drain pan 28 is provided below the indoor heat exchanger 5 to receive and drain the condensed water from the air, which is generated on the indoor heat exchanger 5. This drain pan 28 is surrounded by a heat insulating material 40. Furthermore, an electronic component box 50 is provided to the right of (outside in the longitudinal direction) and above the indoor heat exchanger 5. Below the electronic component box 50, a sensor mounting portion 70 (see FIG. 11C) is provided. To this sensor mounting portion 70, a refrigerant gas sensor 9 is detachably attached. This refrigerant gas sensor 9 is provided to the right of (outside in the longitudinal direction) the indoor heat exchanger 5 and the drain pan 28. As shown in FIG. 5, the electronic component box 50 includes a harness connection portion 52 with which a harness 68 extending from the refrigerant gas sensor 9 is connected. As shown in FIG. 5, in the longitudinal direction (left-right direction) of the indoor heat exchanger 5, the harness 68 is farther from the indoor heat exchanger 5 as compared to refrigerant pipes 5*a* and 5*b* which extend from the indoor heat exchanger 5 and which are connected with communication pipes L1 and L2.

(Drain Pan)

Figure 8A:
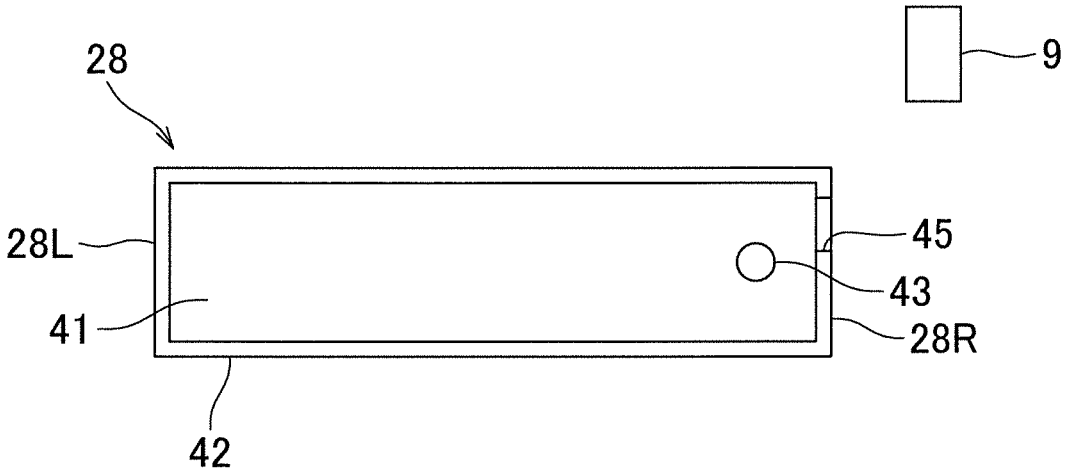
FIG. 8A is a plan view of a drain pan shown in FIG. 6.
Figure 8B:
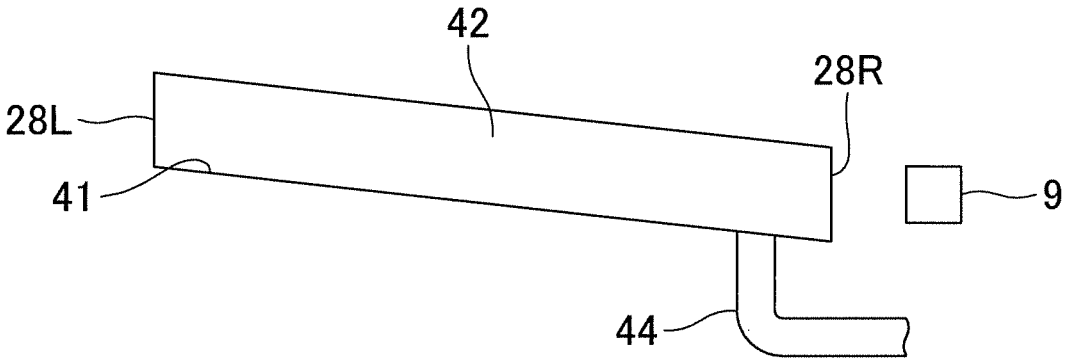
FIG. 8B is a front elevation of the drain pan.
Figure 8C:
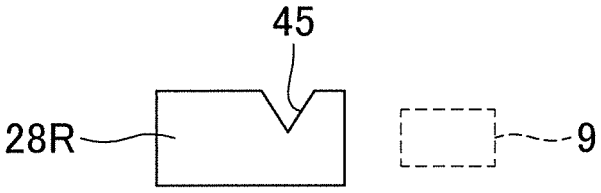
FIG. 8C is a right profile of the drain pan.

As shown in FIG. 8A, the drain pan 28 includes a bottom portion 41 and a peripheral wall portion 42 extending upward from the entire outline of the bottom portion 41. This drain pan 28 has a discharge hole 43 at around the right end 28R in the longitudinal direction (i.e., an end portion on the refrigerant gas sensor side) to discharge condensed water. The discharge hole 43 is connected with a drain hose 44. This drain hose 44 extends to reach the outside of the room together with the communication pipes L1 and L2. As shown in FIG. 8B, the bottom portion 41 of the drain pan 28 is tilted downward in the direction from the left end 28L to the right end 28R (i.e., tilted downward toward the refrigerant gas sensor in the longitudinal direction). The condensed water having fallen onto the drain pan 28 from the indoor heat exchanger 5 flows on the drain pan 28 from the left end 28L side to the right end 28R side and is then discharged from the discharge hole 43. In FIG. 8B, the inclination of the bottom portion 41 of the drain pan 28 is exaggerated for easy understanding. Furthermore, as shown in FIG. 8C, a notch 45 is formed in the peripheral wall portion 42 of the drain pan 28 on the refrigerant gas sensor 9 side. To be more specific, the notch 45 is formed in a side face on the right end 28R side of the drain pan 28 (i.e., the right side face of the peripheral wall portion 42). The phrase "the peripheral wall portion on the refrigerant gas sensor side" indicates a part of the peripheral wall portion 42, which is on the refrigerant gas sensor 9 side of the center in the longitudinal direction (i.e., the center in the left-right direction) of the indoor heat exchanger 5. The notch is therefore not always required to be formed in the right side face of the peripheral wall portion 42, and may be formed in any part of the peripheral wall portion 42, on condition that the part is on the refrigerant gas sensor 9 side.

In this air conditioner, when refrigerant gas accidentally leaks out due to a reason such as the breakage of a refrigerant pipe in the indoor heat exchanger 5, the refrigerant gas having the higher specific gravity than air flows downward and reaches the drain pan 28. The refrigerant gas having reached the drain pan 28 flows from the left end 28L side toward the right end 28R side along the inclination of the drain pan 28. On this account, the refrigerant gas having reached the drain pan 28 tends to overflow the drain pan 28 on the refrigerant gas sensor 9 side in the longitudinal direction. In particular, the refrigerant gas tends to overflow through the notch 45 formed in the peripheral wall portion 42. The overflow refrigerant gas stagnates at the bottom of the indoor unit 20, and leaks out of the indoor unit 20.

(Electronic Component Box)

Figure 9:
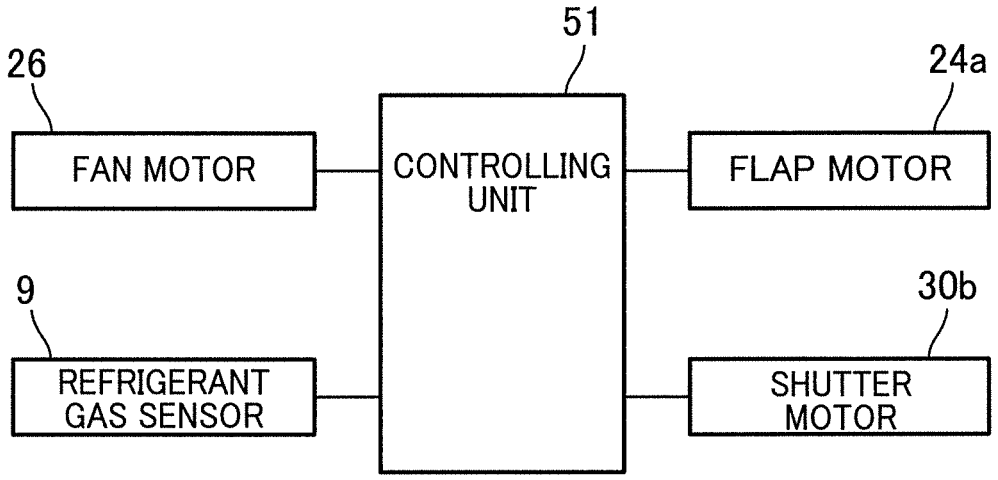
FIG. 9 shows a control block of the indoor unit.

The electronic component box 50 houses a controlling unit 51 therein for controlling components required for operations such as the cooling and warming operations of the air conditioner. As shown in FIG. 9, this controlling unit 51 is connected with the fan motor 26, the refrigerant gas sensor 9, the flap motor 24*a*, and the shutter motor 30*b*, controls the indoor fan 8, the vertical flap 24, and the shutter 30, and determines whether refrigerant leakage occurs based on a result of detection of the refrigerant gas by the refrigerant gas sensor 9.

(Refrigerant Gas Sensor)

The refrigerant gas sensor 9 is a sensor configured to detect leaked refrigerant gas, and is provided to be flush with or lower than the drain pan 28 as shown in FIG. 5. The refrigerant gas sensor 9 is provided to the right of (outside in the longitudinal direction of) the drain pan 28 and to be rearward of (i.e., behind) the drain pan 28 and the indoor heat exchanger 5.

Figure 10A:
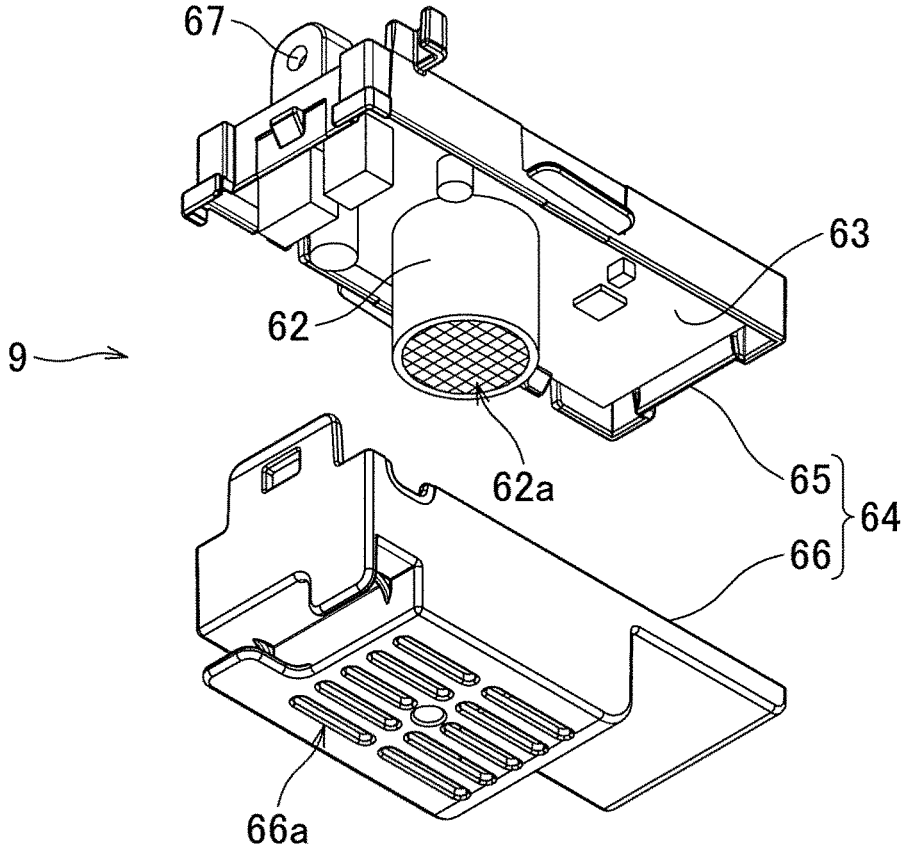
Figure 10B:
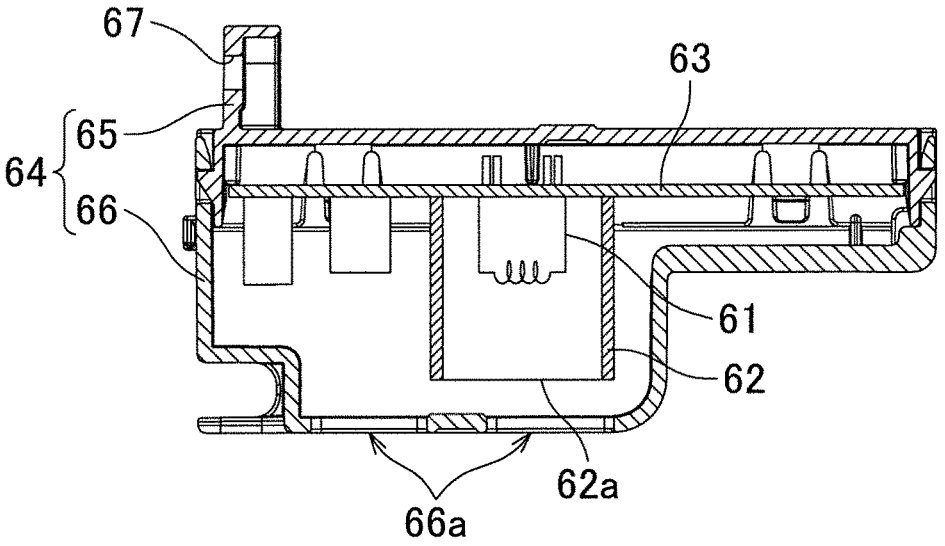
FIG. 10B is a cross section of the refrigerant gas sensor.

As shown in FIGS. 10A and 10B, this refrigerant gas sensor 9 includes a detecting element 61 configured to detect refrigerant gas, a hollow (e.g., cylindrical) casing member 62 provided around the detecting element 61, a printed board 63 having a lower surface to which the detecting element 61 and the casing member 62 are fixed, and a housing 64 covering the printed board 63.

The casing member 62 has, at its lower end, a casing opening 62*a* which is provided to introduce leaked refrigerant gas into the casing member 62. To the casing opening 62*a*, for example, a meshed filter is attached. As shown in FIG. 10B, the casing opening 62*a* is formed to be along the horizontal plane, and the entirety of the casing opening 62*a* is provided below the detecting element 61. The upper end of the casing member 62 is closed by the printed board 63 to prevent refrigerant gas from being introduced into the casing member 62 through an opening other than the casing opening 62*a*. The housing 64 includes a first housing 65 covering the circumference and the top of the printed board 63 and a second housing 66 covering the circumference and the bottom of the printed board 63 and the casing member 62. In the bottom surface of the second housing 66, slits 66*a* are formed. In regard to this refrigerant gas sensor 9, refrigerant gas is taken into the housing 64 only through the slits 66*a*. In the first housing 65, a hole 67 is formed to receive a later-described screw (fixing member) S.

Figure 11B:
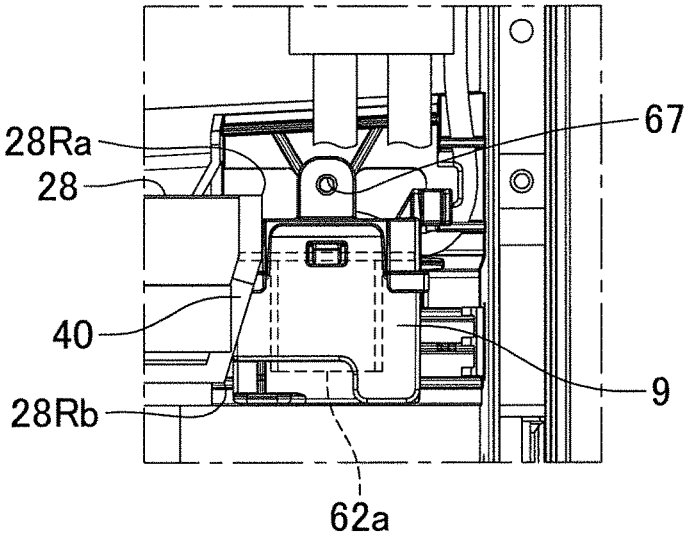
FIG. 11B is identical with FIG. 11A except that a communication pipe is not shown.
Figure 11C:
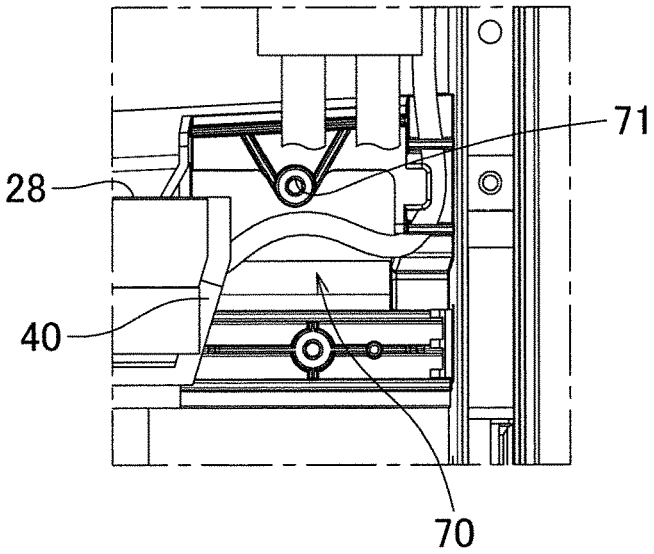
FIG. 11C is identical with FIG. 11C except that the refrigerant gas sensor has been detached.

The phrase "the refrigerant gas sensor is provided to be flush with the drain pan" indicates that, as shown in FIG. 11B, the casing opening 62*a* of the refrigerant gas sensor 9 is provided between the upper end 28Ra and the lower end 28Rb of the right end 28R of the drain pan 28. The phrase "the refrigerant gas sensor is provided to be lower than the drain pan" indicates that the casing opening 62*a* of the refrigerant gas sensor 9 is provided below the lower end 28Rb of the right end 28R of the drain pan 28.

Figure 12A:
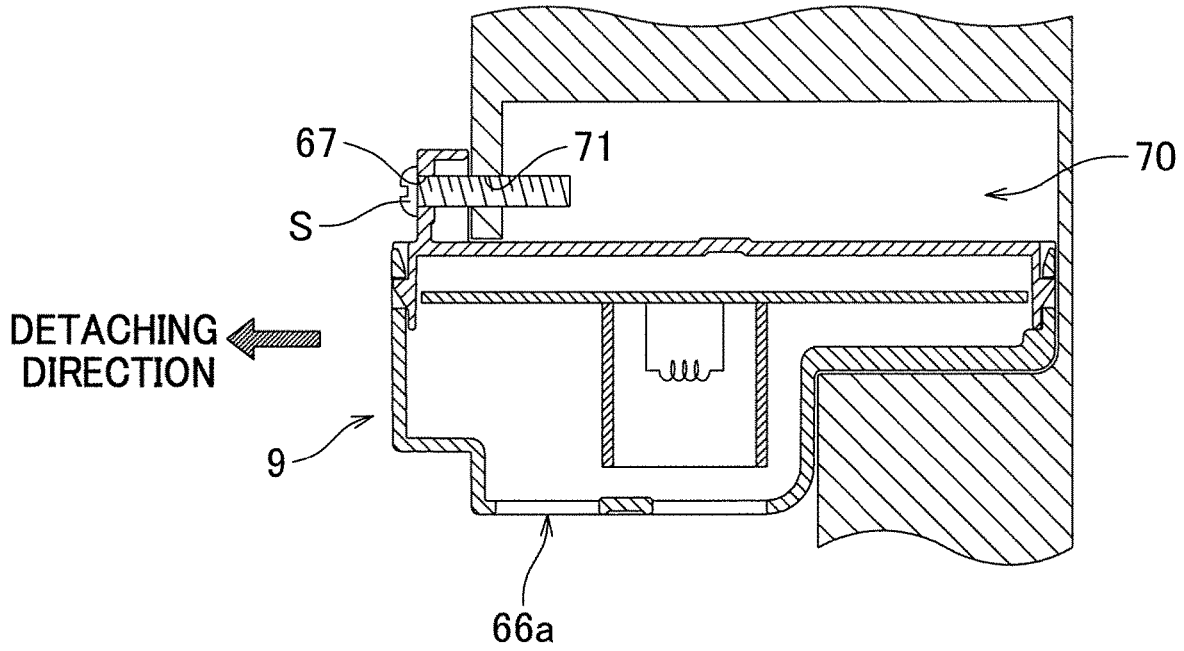
FIG. 12A is a cross section showing a state that the refrigerant gas sensor is attached to a sensor mounting portion, whereas FIG. 12B explains how the refrigerant gas sensor is detached.
Figure 12B:
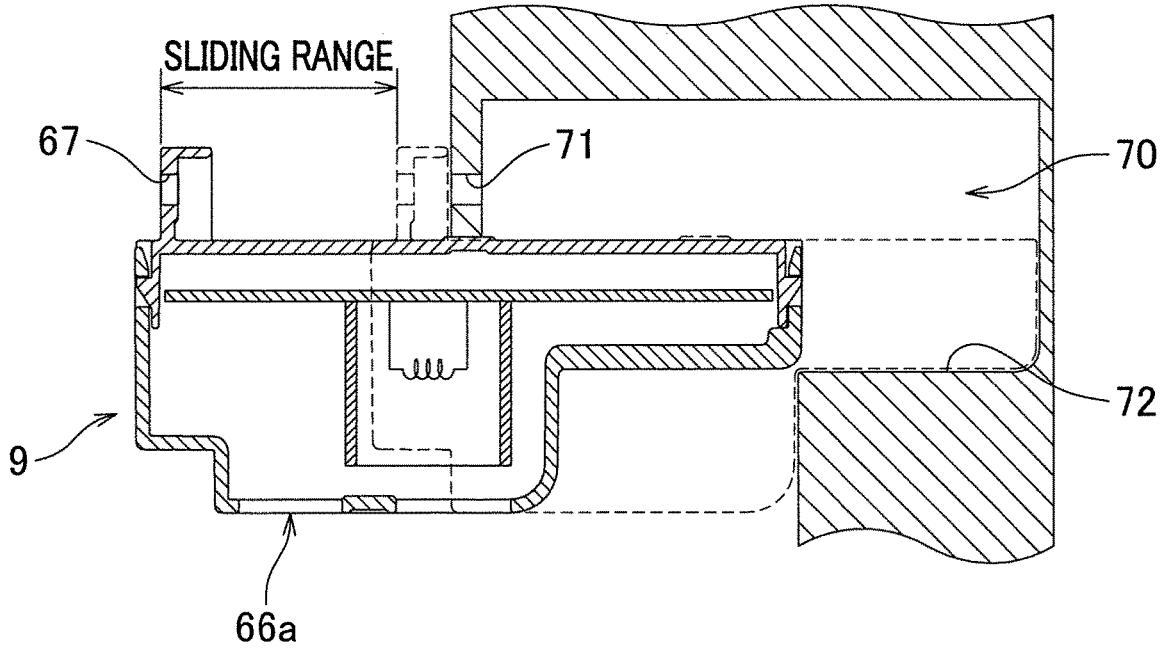

As shown in FIG. 11 and FIG. 12, the sensor mounting portion 70 has: a screw hole (sensor fixing portion) 71 for attaching the refrigerant gas sensor 9; and a housing portion 72 in which a rear end portion of the refrigerant gas sensor 9 is housed. As shown in FIG. 12A, when the refrigerant gas sensor 9 is attached to the sensor mounting portion 70, the rear end portion of the refrigerant gas sensor 9 is housed in the housing portion 72 and the screw (fixing member) S inserted into the hole 67 of the refrigerant gas sensor 9 is screwed into the screw hole (sensor fixing portion) 71.

In regard to this refrigerant gas sensor 9, to detach the refrigerant gas sensor 9 from the sensor mounting portion 70, to begin with, the screw (fixing member) S is taken out from the screw hole (sensor fixing portion) 71 in the forward direction (the direction in which the fixing member is taken out (see FIG. 12A), and then the refrigerant gas sensor 9 is slid in the forward direction (the detaching direction of the refrigerant gas sensor (see FIG. 12B) relative to the sensor mounting portion 70, for a predetermined distance (predetermined sliding range). In this way, the refrigerant gas sensor 9 is detached.

In this indoor unit 20, as shown in FIG. 5 to FIG. 7 and FIG. 11A, when the front grill 22 and the front panel 23 (casing 20*a*) provided on the side toward which the refrigerant gas sensor 9 is detached are open (detached), the communication pipes (regulating members) L1 and L2 are provided on the side toward which the refrigerant gas sensor 9 is detached, in order to regulate the detachment of the refrigerant gas sensor 9. When a service technician, a user, or the like detaches the front grill 22 and the front panel 23 (casing 20*a*) and performs maintenance of the indoor unit 20, the communication pipes L1 and L2 do not allow the refrigerant gas sensor 9 to be easily detached, when he/she erroneously tries to detach the refrigerant gas sensor 9.

The communication pipes L1 and L2 are communication pipes (refrigerant pipes) connected with refrigerant pipes 5*a* and 5*b* extending from the indoor heat exchanger 5. The communication pipes L1 and L2 are provided at a lower part the indoor unit 20, behind the indoor unit 20, and on the outdoor unit 10 side. The two communication pipes L1 and L2 are covered with, for example, a single heat insulating material H. As such, the two communication pipes L1 and L2 are covered with the heat insulating material H. On this account, as compared to cases where the communication pipes L1 and L2 are naked, a hand or a screwdriver is less likely to access to the refrigerant gas sensor 9 and the screw S. It is therefore further difficult to detach the refrigerant gas sensor 9. The same effect is obtained when the two communication pipes are covered with different heat insulating materials, respectively.

As shown in FIG. 5, connecting portions L1*a* and L2*a* of the communication pipes L1 and L2, which are connected with the refrigerant pipes 5*a* and 5*b*, are provided above the refrigerant gas sensor 9. A service technician, a user, or the like is allowed to detach the refrigerant gas sensor 9 only after the refrigerant flowing in the refrigerant circuit is removed and the communication pipes L1 and L2 are detached from the refrigerant pipes 5*a* and 5*b*.

The phrase "the detaching direction of the refrigerant gas sensor (the direction in which the refrigerant gas sensor is detached)" indicates the direction in which the fixing member is detached, in cases where the refrigerant gas sensor is fixed to the sensor fixing portion via the fixing member. On this account, "the detaching direction of the refrigerant gas sensor (the direction in which the refrigerant gas sensor is detached)" indicates the direction in which the fixing member is detached, even if the refrigerant gas sensor drops down when the fixing member fixed to the sensor fixing portion is detached. In cases where the refrigerant gas sensor is slid in the detaching direction of the refrigerant gas sensor, the phrase "the detaching direction of the refrigerant gas sensor (the direction in which the refrigerant gas sensor is detached)" indicates the sliding direction. In cases where the refrigerant gas sensor is fixed to the sensor fixing portion via the fixing member and the refrigerant gas sensor is slid in the detaching direction of the refrigerant gas sensor as in the present embodiment, the phrase "the detaching direction of the refrigerant gas sensor (the direction in which the refrigerant gas sensor is detached)" indicates the direction in which the fixing member is taken out and the sliding direction of the refrigerant gas sensor. In the present embodiment, "the detaching direction of the refrigerant gas sensor (the direction in which the refrigerant gas sensor is detached)" is the forward direction because the direction in which fixing member is taken out and the sliding direction of the refrigerant gas sensor are both the forward direction. When the direction in which the fixing member is taken out is different from the sliding direction of the refrigerant gas sensor, these two directions are "the detaching directions of the refrigerant gas sensor (the direction in which the refrigerant gas sensor is detached)".

Because the "regulating member" is configured to regulate the detachment of the refrigerant gas sensor, the regulating member is required to be provided at a position where the regulation of the detachment of the refrigerant gas sensor is possible. In the present embodiment, as shown in FIG. 11A, at least a part of at least one of the communication pipes L1 and L2 which are the regulating members overlaps the refrigerant gas sensor 9 in a front view when the refrigerant gas sensor 9 is attached to the sensor mounting portion 70, and is in the sliding range of the refrigerant gas sensor 9 (see FIG. 12B). Furthermore, when the screw S is screwed into the screw hole 71, the communication pipes L1 and L2 are positioned to obstruct the screw S from being taken out by a screwdriver, i.e., are provided at around positions overlapping the screw S in a front view, and the distance between the screw S and each of the communication pipes L1 and L2 is arranged to be equal to or shorter than the length of the screwdriver.

Characteristics of Indoor Unit of Air Conditioner of Present Embodiment

The indoor unit 20 of the air conditioner of the present embodiment has the following characteristics. In this indoor unit 20, when the front grill 22 and the front panel 23 (casing 20*a*) provided on the side toward which the refrigerant gas sensor 9 is detached are open (detached), the communication pipes (regulating members) L1 and L2 regulating the detachment of the refrigerant gas sensor 9 are provided on the side toward which the refrigerant gas sensor 9 is detached. This prevents the refrigerant gas sensor 9 from being easily detached. This prevents malfunction of the refrigerant gas sensor 9 due to erroneous detachment of the refrigerant gas sensor 9 by a service technician or the like.

In the indoor unit 20 of the air conditioner of the present embodiment, in the arrangement in which the refrigerant gas sensor 9 is detached from the sensor mounting portion 70 in such a way that the refrigerant gas sensor 9 is slid in the detaching direction of the refrigerant gas sensor 9, the communication pipes (regulating members) L1 and L2 are provided in the sliding range of the refrigerant gas sensor 9. It is therefore possible to prevent the refrigerant gas sensor 9 from being easily detached.

In the indoor unit 20 of the air conditioner of the present embodiment, in the arrangement in which the refrigerant gas sensor 9 is detached from the sensor mounting portion 70 after the screw (fixing member) S is taken out (detached) from the screw hole (sensor fixing portion) 71, the communication pipes (regulating members) L1 and L2 are provided on the side toward which the screw (fixing member) S is taken out (detached). It is therefore possible to prevent the refrigerant gas sensor 9 from being easily detached.

In the indoor unit 20 of the air conditioner of the present embodiment, when the refrigerant gas sensor 9 is provided on the same side of the electronic component box 50 relative to the indoor heat exchanger 5 and hence the refrigerant gas sensor 9 tends to be detached by mistake, the communication pipes (regulating members) L1 and L2 for regulating the detachment of the refrigerant gas sensor 9 are provided on the side toward which the refrigerant gas sensor 9 is detached. It is therefore possible to prevent the refrigerant gas sensor 9 from being easily detached.

Furthermore, in the indoor unit 20 of the air conditioner of the present embodiment, because the regulating members are the communication pipes L1 and L2 connected with the refrigerant pipes 5*a* and 5*b* extending to the indoor heat exchanger 5, the refrigerant gas sensor 9 cannot be detached unless the refrigerant in the refrigerant circuit is removed and the communication pipes L1 and L2 are detached. It is therefore possible to further prevent the detachment of the refrigerant gas sensor 9. Furthermore, because the detachment of the refrigerant gas sensor 9 is prevented by using the communication pipes L1 and L2 which are conventionally provided inside the indoor unit 20, it is unnecessary to provide an additional arrangement for preventing the detachment of the refrigerant gas sensor 9.

Thus, the embodiments of the present invention have been described hereinabove. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

[First Modification]

Figure 13:
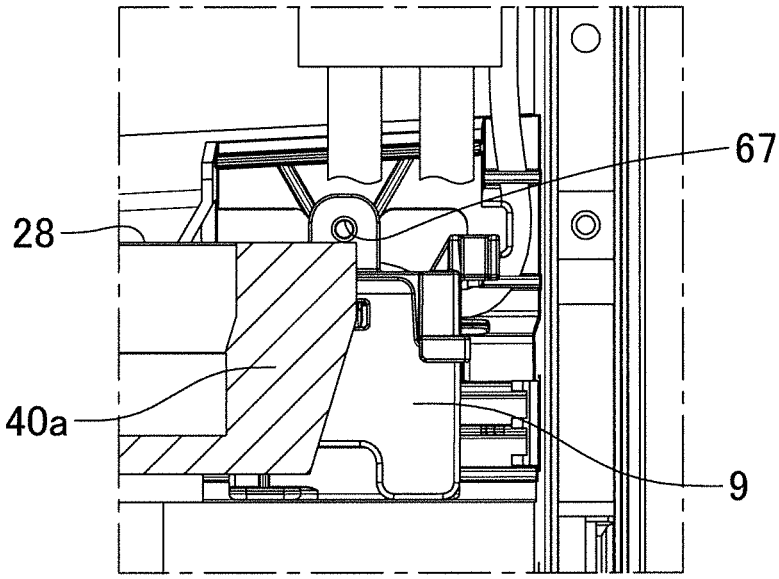
FIG. 13 relates to an indoor unit of an air conditioner according to the first modification of the present invention and is equivalent to FIG. 11B.

The following will describe an indoor unit of an air conditioner of the first modification of the present invention with reference to FIG. 13. As shown in FIG. 13, the indoor unit of the air conditioner of the modification is identical with the indoor unit of the embodiment above except that a heat insulating material (regulating member) 40*a* for regulating the detachment of the refrigerant gas sensor 9 is provided on the side (front side) toward which the refrigerant gas sensor 9 is detached. In FIG. 13, the same reference symbols are used for members identical with those of the embodiment above.

As shown in FIG. 13, the heat insulating material 40*a* is attached to the outer circumference of the drain pan 28. This heat insulating material 40*a* is provided to at least partially overlap the refrigerant gas sensor 9 in a front view and in the sliding range of the refrigerant gas sensor 9. Furthermore, when the screw S is screwed into the screw hole 71, the heat insulating material 40*a* is positioned to obstruct the screw S from being taken out by a screwdriver, i.e., is provided at around a position overlapping the screw S in a front view, and the distance between the screw S and the heat insulating material 40*a* is arranged to be equal to or shorter than the length of the screwdriver. On this account, from the indoor unit of the air conditioner, the refrigerant gas sensor 9 cannot be detached unless the heat insulating material 40*a* is detached.

In the indoor unit of the air conditioner of the first modification, because the detachment of the refrigerant gas sensor 9 is prevented by using the heat insulating material 40*a* which is conventionally provided inside the indoor unit air conditioner, it is unnecessary to provide an additional arrangement for preventing the detachment of the refrigerant gas sensor 9.

[Second Modification]

Figure 14:
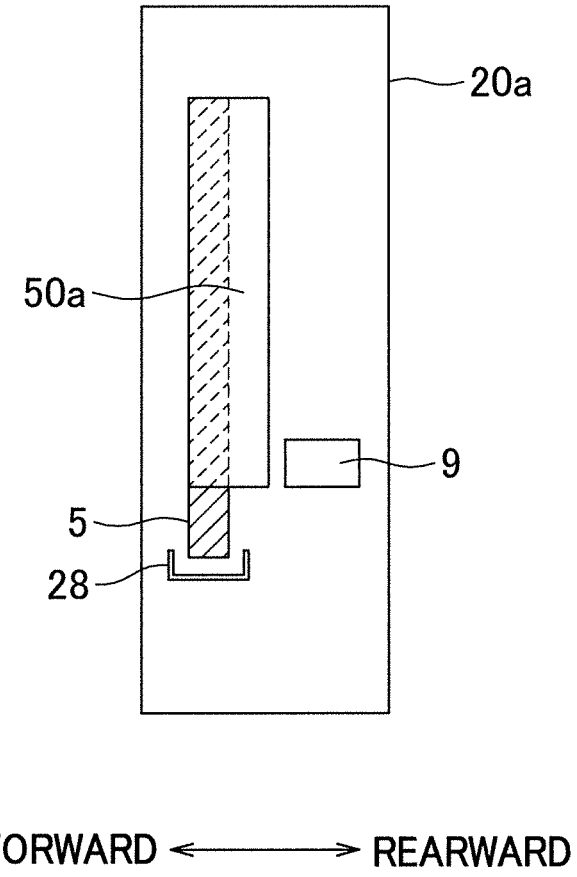
FIG. 14 relates to an indoor unit of an air conditioner according to the second modification of the present invention.

The following will describe an indoor unit of an air conditioner of the second modification of the present invention with reference to FIG. 14. As shown in FIG. 14, the indoor unit of the air conditioner of the modification is identical with the indoor unit of the embodiment above except that an electronic component box (regulating member) 50*a* for regulating the detachment of the refrigerant gas sensor 9 is provided on the side (front side) toward which the refrigerant gas sensor 9 is detached. In FIG. 14, the same reference symbols are used for members identical with those of the embodiment above.

As shown in FIG. 14, being different from the embodiment above, the electronic component box 50*a* is provided on the front side of the refrigerant gas sensor 9. This electronic component box 50*a* is provided, although not illustrated, to at least partially overlap the refrigerant gas sensor 9 in a front view and in the sliding range of the refrigerant gas sensor 9. Furthermore, when the screw S is screwed into the screw hole 71, the electronic component box 50 is positioned to obstruct the screw S from being taken out by a screwdriver, i.e., is provided at around a position overlapping the screw S in a front view, and the distance between the screw S and the heat insulating material 40*a* is equal to or shorter than the length of the screwdriver. On this account, from the indoor unit of the air conditioner, the refrigerant gas sensor 9 cannot be detached unless the electronic component box 50*a* is detached.

In the indoor unit of the air conditioner of the second modification, because the detachment of the refrigerant gas sensor 9 is prevented by using the electronic component box 50*a* which is conventionally provided inside the indoor unit air conditioner, it is unnecessary to provide an additional arrangement for preventing the detachment of the refrigerant gas sensor 9.

[Other Modifications]

In the embodiment above, as the refrigerant gas sensor 9 is slid in the detaching direction of the refrigerant gas sensor 9 after the screw (fixing member) S is taken out from the screw hole (sensor fixing portion) 71, the refrigerant gas sensor 9 is detached from the sensor mounting portion 70. Alternatively, the screw hole (sensor fixing portion) and the screw (fixing member) may not be provided and the refrigerant gas sensor may be detached from the sensor mounting portion by simply sliding the refrigerant gas sensor in the detaching direction of the refrigerant gas sensor, or the sliding mechanism may not be provided and the refrigerant gas sensor is detached from the sensor mounting portion by simply taking the screw (fixing member) out from the screw hole (sensor fixing portion), i.e., the refrigerant gas sensor may drop off when the screw is taken off.

While in the embodiment above the direction in which the screw (fixing member) S is taken out and the sliding direction of the refrigerant gas sensor 9 are both the forward direction, these directions may be the rightward direction, the leftward direction, the upward direction, or the downward direction, and the direction in which the fixing member is taken off may be different from the sliding direction of the refrigerant gas sensor.

While in the embodiment above the regulating member is provided at a position where the regulating member obstructs the screw (fixing member) S from being taken out and is provided within the sliding range of the refrigerant gas sensor 9, the regulating member may be provided at only either at a position where the regulating member obstructs the screw (fixing member) S from being taken out or in the sliding range of the refrigerant gas sensor. When, for example, the direction in which the fixing member is taken out is different from the sliding direction of the refrigerant gas sensor, regulating members may be provided for the both directions or a regulating member is provided for only one of the directions.

While in the embodiment above the casing 20*a* includes the bottom frame 21, the front grill 22, and the front panel 23, the disclosure is not limited to this arrangement. When the detaching direction of the refrigerant gas sensor is the rightward direction, the leftward direction, the upward direction, or the downward direction, the casing preferably includes a right panel, a left panel, an upper panel, or a lower panel, in consideration of the attachment and detachment of the refrigerant gas sensor.

While in the embodiment above the regulating members for regulating the detachment of the refrigerant gas sensor are the communication pipes L1 and L2, the regulating member is not limited to a communication pipe on condition that the detachment of the refrigerant gas sensor is regulated when the casing which is provided on the side toward which the refrigerant gas sensor is detached is open. For example, the regulating member may be a heat insulating material provided on the outer circumference of the drain pan as in the first modification, or the regulating member may be an electronic component box as in the second modification. In addition to the above, the regulating member may be a refrigerant pipe extending from the indoor heat exchanger, another pipe, a heat insulating material covering the outer circumference of the communication pipe, a heat insulating material covering another member, or another member.

In addition to the above, while in the embodiment above the sensor fixing portion and the fixing member are the screw hole 71 and the screw S, respectively, the sensor fixing portion and the fixing member are not limited to them on condition that the fixing member is detached in a predetermined detaching direction from the sensor fixing portion. For example, the fixing member may be a rod member (e.g., a wedge) extending along a predetermined detaching direction, and the sensor fixing portion may be an engaged member with which the rod member (e.g., a wedge) is engaged.

While in the embodiment above the refrigerant gas sensor 9 and the electronic component box 50 are provided on the outer side in the longitudinal direction of the indoor heat exchanger 5 and are on the same side (i.e., to the right of the indoor heat exchanger), the refrigerant gas sensor and the electronic component box may not be provided on the outer side in the longitudinal direction of the indoor heat exchanger and on the same side (i.e., to the right of the indoor heat exchanger). The refrigerant gas sensor may be, for example, provided below, above, or behind the indoor heat exchanger in a front view.

While the embodiment above describes a case where the front grill 22 and the front panel 23 (casing 20*a*) provided on the side toward which the refrigerant gas sensor 9 is detached are detached, the casing provided on the side toward which the refrigerant gas sensor 9 is detached may rotate upward to open.

While in the embodiment above the indoor unit is a floor-mounted indoor unit, the indoor unit may not be floor-mounted, and may be wall-mounted.

INDUSTRIAL APPLICABILITY

The present invention makes it possible to prevent the refrigerant gas sensor from being easily detached.

REFERENCE SIGNS LIST

5: indoor heat exchanger
5*a*, 5*b*: refrigerant pipe
9: refrigerant gas sensor
20: indoor unit
20*a*: casing
40*a*: heat insulating material (regulating member)
50: electronic component box
50*a*: electronic component box (regulating member)
70: sensor mounting portion
71: screw hole (sensor fixing portion)
L1, L2: communication pipe (regulating member)
S screw (fixing member)

The invention claimed is:

1. An indoor unit of an air conditioner using flammable refrigerant, the indoor unit comprising:

an openable and closable casing;

an indoor heat exchanger provided in the casing;

a refrigerant gas sensor housed in the casing and detecting the flammable refrigerant, the refrigerant gas sensor including a housing attachable to the casing;

a sensor mounting portion comprising a recess, in the casing, communicating with an inner space of the casing, and two walls defining the recess, the two walls extending along a first direction and facing directions opposite to each other, the refrigerant gas sensor being attached to the casing by inserting a portion of the refrigerant gas sensor housing in the recess, the recess preventing the refrigerant gas sensor housing from moving in a direction other than the first direction at least for a first distance, a communication pipe connected with a refrigerant pipe extending from the indoor heat exchanger, and a regulating member comprising a portion of the communication pipe positioned outside the recess and distanced, in the first direction, from the attached refrigerant gas sensor by a second distance which is shorter than the first distance and at least partially overlapping the refrigerant gas sensor when the indoor unit is viewed along the first direction, the portion of the communication pipe acting as the regulating member obstructing the refrigerant gas sensor housing from being located outside the recess by moving in the first direction, wherein movement of the attached refrigerant gas sensor in the first direction for a distance greater than or equal to the first distance detaches the refrigerant gas sensor from the casing.

2. The indoor unit according to claim 1, further comprising a heat insulating material provided on at least the portion of the communication pipe.

3. The indoor unit according to claim 1, wherein, the casing includes an opening and a panel which opens and closes the opening, and the panel is distanced from the refrigerant gas sensor in the first direction.

4. The indoor unit according to claim 1, further comprising an electronic component box housed in the casing, the casing including an opening and a panel which opens and closes the opening, and when the indoor unit is viewed along a direction orthogonal to the panel, the refrigerant gas sensor and the electronic component box being either both provided to the right of a right end of the indoor heat exchanger or both provided to the left of a left end of the indoor heat exchanger.

5. The indoor unit according to claim 4, further comprising a heat insulating material provided on at least the portion of the communication pipe.

6. The indoor unit according to claim 1, wherein, the refrigerant gas sensor has a hole and the sensor mounting portion has a hole, the two holes lining up in one direction, the indoor unit further comprising a screw, and the screw is inserted into the two holes and is engaged at least with the hole formed in the sensor mounting portion, so as to fix the refrigerant gas sensor housing to the sensor mounting portion.

7. The indoor unit according to claim 6, wherein, the one direction in which the two holes are lined up is the first direction.

8. The indoor unit according to claim 7, wherein, the regulating member is located at a position deviated from the screw in the first direction and at least partially overlaps the screw when the indoor unit is viewed in the direction along the first direction.

9. The indoor unit according to claim 6, further comprising a heat insulating material provided on at least the portion of the communication pipe.

10. The indoor unit according to claim 6, further comprising an electronic component box housed in the casing, the casing including an opening and a panel which opens and closes the opening, and when the indoor unit is viewed along a direction orthogonal to the panel, the refrigerant gas sensor and the electronic component box being either both provided to the right of a right end of the indoor heat exchanger or both provided to the left of a left end of the indoor heat exchanger.

11. The indoor unit according to claim 10, further comprising a heat insulating material provided on at least the portion of the communication pipe.

12. An indoor unit of an air conditioner using flammable refrigerant, the indoor unit comprising:

an openable and closable casing;

an indoor heat exchanger provided in the casing;

a refrigerant gas sensor housed in the casing and detecting the flammable refrigerant, the refrigerant gas sensor including a housing attachable to the casing;

a sensor mounting portion comprising a recess, in the casing, communicating with an inner space of the casing, and two walls defining the recess, the two walls extending along a first direction and facing directions opposite to each other, the refrigerant gas sensor being attached to the casing by inserting a portion of the refrigerant gas sensor housing in the recess, the recess preventing the refrigerant gas sensor housing from moving in a direction other than the first direction at least for a first distance, and a regulating member comprising a heat insulating material positioned outside the recess and distanced, in the first direction, from the attached refrigerant gas sensor by a second distance which is shorter than the first distance and at least partially overlapping the refrigerant gas sensor when the indoor unit is viewed along the first direction, the heat insulating material obstructing the refrigerant gas sensor housing from being located outside the recess by moving in the first direction, wherein movement of the attached refrigerant gas sensor in the first direction for a distance greater than or equal to the first distance detaches the refrigerant gas sensor from the casing.

13. An indoor unit of an air conditioner using flammable refrigerant, the indoor unit comprising:

an openable and closable casing;

an indoor heat exchanger provided in the casing;

a refrigerant gas sensor housed in the casing and detecting the flammable refrigerant, the refrigerant gas sensor including a housing attachable to the casing;

a sensor mounting portion comprising a recess, in the casing, communicating with an inner space of the casing, and two walls defining the recess, the two walls extending along a first direction and facing directions opposite to each other, the refrigerant gas sensor being attached to the casing by inserting a portion of the refrigerant gas sensor housing in the recess, the recess preventing the refrigerant gas sensor housing from moving in a direction other than the first direction at least for a first distance, and a regulating member comprising an electronic component box housed in the casing and positioned outside the recess and distanced, in the first direction, from the attached refrigerant gas sensor by a second distance which is shorter than the first distance and at least partially overlapping the refrigerant gas sensor when the indoor unit is viewed along the first direction, the electronic component box obstructing the refrigerant gas sensor housing from being located outside the recess by moving in the first direction, wherein the casing includes an opening and a panel which opens and closes the opening, when the indoor unit is viewed along a direction orthogonal to the panel, the refrigerant gas sensor and the electronic component box are either both provided to the right of a right end of the indoor heat exchanger or both provided to the left of a left end of the indoor heat exchanger, and movement of the attached refrigerant gas sensor in the first direction for a distance greater than or equal to the first distance detaches the refrigerant gas sensor from the casing.

* * * * *